US008701767B2

(12) United States Patent
Andrzejak et al.

(10) Patent No.: US 8,701,767 B2
(45) Date of Patent: Apr. 22, 2014

(54) BORON SHAPED CHARGE

(75) Inventors: Timothy A. Andrzejak, Sugar Land, TX (US); Claude Dewayne Jones, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 62 days.

(21) Appl. No.: 13/327,805

(22) Filed: Dec. 16, 2011

(65) Prior Publication Data

US 2012/0160492 A1 Jun. 28, 2012

Related U.S. Application Data

(60) Provisional application No. 61/427,647, filed on Dec. 28, 2010.

(51) Int. Cl.
*E21B 43/116* (2006.01)
*E21B 43/117* (2006.01)

(52) U.S. Cl.
USPC ..... 166/297; 102/306; 102/307; 89/1.15

(58) Field of Classification Search
USPC ..... 166/297; 102/306, 307; 89/1.15
See application file for complete search history.

(56) References Cited

U.S. PATENT DOCUMENTS

| | | | | |
|---|---|---|---|---|
| 5,859,383 | A * | 1/1999 | Davison et al. | 102/307 |
| 7,393,423 | B2 | 7/2008 | Liu | |
| 2006/0266551 | A1* | 11/2006 | Yang et al. | 175/4.6 |
| 2007/0056462 | A1 | 3/2007 | Bates et al. | |
| 2008/0282924 | A1 | 11/2008 | Saenger et al. | |
| 2009/0078144 | A1 | 3/2009 | Behrmann et al. | |
| 2010/0096136 | A1 | 4/2010 | Bourne et al. | |
| 2011/0056362 | A1* | 3/2011 | Yang et al. | 89/1.15 |
| 2011/0155013 | A1* | 6/2011 | Boyer et al. | 102/307 |

FOREIGN PATENT DOCUMENTS

WO 2005035939 A1 4/2005

* cited by examiner

*Primary Examiner* — Giovanna Wright
(74) *Attorney, Agent, or Firm* — Jeffery R. Peterson; Brandon S. Clark

(57) ABSTRACT

A shaped charge includes a casing; a liner located within an opening of the casing; and an explosive located in the region between the casing and the liner, wherein at least one of the liner and the explosive comprises an intermetallic mixture comprising boron and a reactant metal. The reactant metal is one selected from the group consisting of Ti, Mg, Zr, Mo, and a combination thereof. A method for perforating in a well includes positioning a perforating gun in the well, wherein the perforating gun includes a shaped charge that includes: a casing; a liner located within an opening of the casing; and an explosive located in the region between the casing and the liner, wherein at least one of the liner and the explosive includes an intermetallic mixture that contains boron and a reactant metal; and detonating the shaped charge in the well.

17 Claims, 6 Drawing Sheets

BORON SHAPED CHARGE

CROSS-REFERENCE TO RELATED APPLICATIONS

The application claims priority of the U.S. Provisional Application No. 61/427,647 filed on Dec. 28, 2010. The disclosure of this provisional application is incorporated by reference in its entirety.

BACKGROUND OF INVENTION

1. Field of the Invention

The invention relates generally to shaped charges for perforating, particularly shaped charges having reactive liners.

2. Background Art

After a well has been drilled and casing has been cemented in the well, perforations are created to allow communication of fluids between pay zones in the formation and the wellbore. Shaped charge perforating is commonly used, in which shaped charges are mounted in perforating guns that are conveyed into the well on either an electric line (e.g., a wireline) or tubing (e.g. production tubing, drill pipe, or coiled tubing).

FIG. 1 shows that, after a well 11 is drilled, a casing 12 is typically run in the well 11 and cemented to the well 11 in order to maintain well integrity. After the casing 12 has been cemented in the well 11, one or more sections of the casing 12 that are adjacent to a formation zone of interest, otherwise referred to as a "target zone," may be perforated to allow fluids from the target zone 13 to flow into the well for production to the surface or to allow injection fluids to be applied into the target zone 13. To perforate a casing section, a perforating device, such as a perforating gun 15, may be lowered into the well 11 to a desired depth, such as at a depth corresponding to the target zone 13 in the surrounding formation 16. Next, one or more shaped charges 20 are fired to create holes in the casing 12 and to create perforations into the target zone 13 of the formation 16. Production fluids in the target zone 13 can then flow through the fractures, through the perforation in the casing, and into the wellbore.

A shaped charge for a perforating device typically includes an energy source located within a shaped charge casing and enclosed with a liner. Energy sources typically include explosive materials. Liners may be made of metals, alloys and/or ceramics. The liner is shaped, such that upon detonation of the explosives, the energy that is released converts the liner material into a directional perforating jet that penetrates the well casing and the adjacent formation to create perforation tunnels. The perforation tunnels allow formation fluids to communicate with the wellbore. In some instance, residual liner material can coat the pores in the perforation tunnel walls and can be harmful to the permeability in the perforation tunnels. On the other hand, these liner materials that are converted into the shaped charge jet can offer an opportunity to enhance the performance characteristics of shaped charges.

In recent years, shaped charges with reactive liners have been developed. The reactive liners are made of reactive materials that can generate additional heat and/or pressure inside the perforation tunnels. Such secondary events can improve the performance characteristics of the shaped charges. For example, a reactive liner composition may include a reactive metal or a reactive metal mixture, such as Al, Ti, Mg, an intermetallic mixture (e.g., Al and Ni), or a thermite mixture (e.g., Al and a metal oxide), that can generate substantial heat inside the newly created perforation tunnels.

The term "thermite" refers to a pyrotechnic composition that comprises a metal powder and a metal oxide. Thermite mixtures can undergo exothermic oxidation-reduction reactions, known as thermite reactions. Most thermite reactions are not explosive in nature, but are characterized by a large energy release in the form of extremely high heat. Aluminum (Al) is among the most common powders used in thermite compositions. Examples of Al-containing thermite compositions include $Al/Fe_2O_3$, $Al/Fe_3O_4$, and Al/CuO, which are at present incorporated into shaped charge liners.

Thermite reactions generally are more energetic than intermetallic reactions owing to the amount of energy released by the Al oxidation reaction. A major disadvantage related to the incorporation of thermite-type mixtures into shaped charge liners, however, is that the only available method involves the separate addition of each component into the powder mixture used to generate the liners. For example, Al powder and $Fe_2O_3$ powder must separately be added into the liner powder mixture. After detonation of the shaped charges, the Al powder and $Fe_2O_3$ powder in the penetration jets then need to find each other before the thermite reactions can take place. Thus, the reaction rate may be hindered by the Al and $Fe_2O_3$ particles having to "find" each other in order to react, and it is likely that some Al and $Fe_2O_3$ remain un-reacted.

An intermetallic composition consists of two or more metallic elements. Some intermetallic compositions can undergo exothermic reactions upon activation. Such exothermic intermetallic reactions may be used for perforating applications. For example, WO 2005/035939, entitled "Improvements in and Relating To Oil Well Perforators," by Leslie Bates and Brian Bourne, discloses uses of intermetallic reaction systems in shaped charge liners. Specifically, WO 2005/035939 discloses the use of Al/Ni and Al/Pd intermetallic compositions in shaped charge liners to enhance performance.

In addition to uses with a metal oxide, as in a thermite mixture, aluminum can also react with various reagents to produce heat. For example, U.S. Pat. No. 7,393,423 B2, entitled "Use of Aluminum in Perforating and Stimulating a Subterranean Formation and other Engineering Applications," issued to Liquing Liu in 2008, discloses the use of Al in liners, based on various oxidation reactions.

U.S. Patent Application Publication No. 2009/0078144 A1, entitled "Liner for Shaped Charges," by Lawrence Behrmann and Wenbo Yang, discloses the use of a variety of energetic metals, including Ti, Mg, and Al, in liners. The Astro Silver™ charges from Schlumberger Technologies (Houston, Tex.) also contain Ti as an energetic material in the liner. These types of shaped charges depend on the reactive elements in the liners to interact with either the explosive decomposition products or materials external to the perforating gun, such as water or the reservoir rock/fluids.

These reactive liners all provide enhancements to shaped charge perforation characteristics. There remains, however, a need to improve upon shaped charge technology and achieve further improvements in shaped charge performance characteristics.

SUMMARY OF INVENTION

One aspect of the invention relates to shaped charges. A shaped charge in accordance with one embodiment of the invention includes a casing; a liner located within an opening of the casing; and a region containing explosive between the casing and the liner, wherein at least one of the liner and the explosive comprises an intermetallic mixture comprising boron and a reactant metal.

One aspect of the invention relates to perforating guns. A perforating gun in accordance with one embodiment of the invention includes a shaped charge that includes a casing; a liner located within an opening of the casing; and an explosive located in the region between the casing and the liner, wherein at least one of the liner and the explosive comprises an intermetallic mixture comprising boron and a reactant metal.

One aspect of the invention relate to methods for manufacturing a shaped charge. A method in accordance with one embodiment of the invention includes obtaining an intermetallic mixture comprising boron and a reactant metal; and preparing a shaped charge comprising a casing; a liner located within an opening of the casing; and an explosive located in the region between the casing and the liner, wherein at least one of the liner and the explosive incorporates intermetallic mixture comprising boron and a reactant metal.

One aspect of the invention relates to methods for perforating a well. A method in accordance with one embodiment of the invention includes: positioning a perforating gun; and detonating the shaped charge in the well, wherein the perforating gun includes a shaped charge that includes a casing; a liner located within an opening of the casing; and an explosive located in the region between the casing and the liner, wherein at least one of the liner and the explosive comprises an intermetallic mixture comprising boron and a reactant metal.

Other aspects and advantages of the invention will be apparent from the following description and the appended claims.

DETAILED DESCRIPTION

Figure 1:
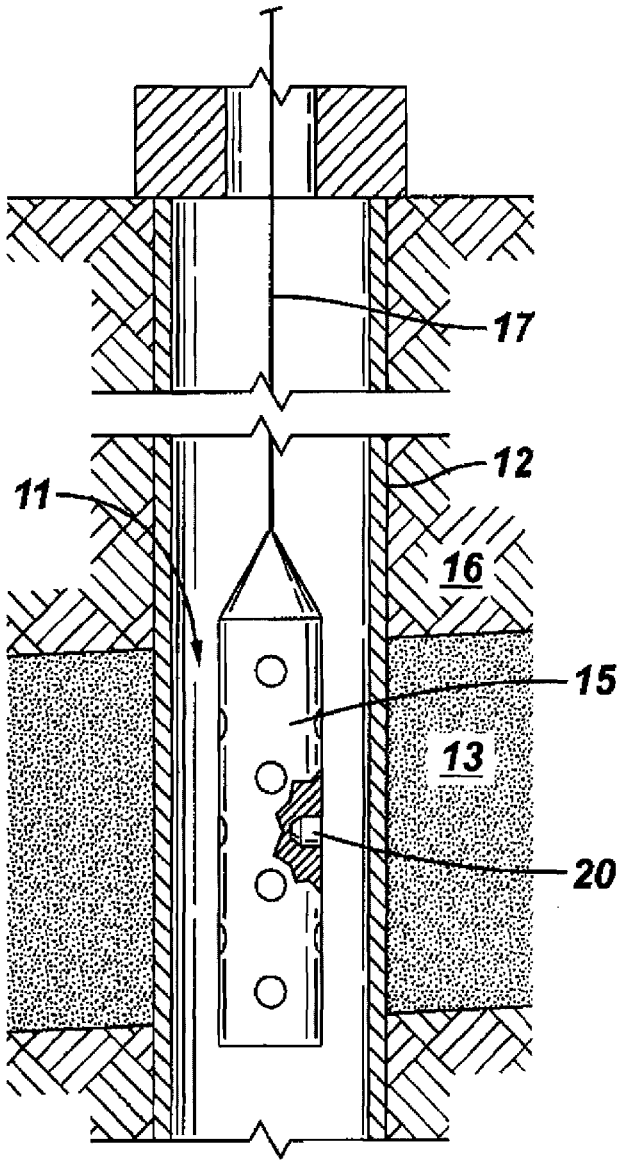
FIG. 1 (Prior Art)
FIG. 1 shows a perforation operation of the prior art, illustrating a perforation device disposed in a well.

Embodiments of the invention relate to shaped charges and methods for using such shaped charges. Specifically, embodiments of the invention relate to shaped charges that use boron intermetallic reactions to enhance the performance of the shaped charges. The following description concerns a number of embodiments and is meant to provide an understanding of the invention. The description is not in any way meant to limit the scope of any present or subsequent related claims.

As noted above, various approaches have been used to enhance the performance of shaped charges, such as the use of reactive liners. Several types of reactive liners have been attempted based on different exothermic reactions that occur after the explosives have been detonated. These secondary reactions include thermite reactions, intermetallic reactions, etc. These exothermic reactions can generate a large amount of heat, which elevates the temperature in the perforation tunnel and expands any gases that are present from the explosive decomposition. This in effect can create pressures that generate cracks in the walls of the perforation tunnels. These reaction systems can also be incorporated with other components that produce gaseous byproducts, which in combination with the elevated temperature can enhance the fracturing effects.

Some reactive liners contain reactive metals that can react with external components, such as components in the formation or the decomposition products of the explosives. When a shaped charge is fired, the explosives or propellants generate decomposition products that mainly contain $CO_2$ and water vapor. Both $CO_2$ and water may oxidize reactive metals (e.g., aluminum, titanium, magnesium, or boron). Therefore, if a liner contains such a reactive metal (e.g., Al, Ti, Mg, or B), the secondary reaction would generate heat to achieve greater energy release, and hence result in better performance characteristics.

Although boron is generally more energetic than Al when applied to such oxidation reactions and could potentially be used as an energetic additive to enhance explosive or propellant performance, boron is not commonly used in such systems. Instead, aluminum is more commonly applied in these types of applications. Boron is not commonly used with propellants and explosives owing to complications encountered during boron oxidation. For example, boron oxidation in the presence of water will form $HBO_2$, which hinders subsequent oxidation, leading to a slower reaction rate and an incomplete reaction (i.e. some boron remains unreacted).

Boron may also be used in thermite reactions. For example, the B/CuO thermite reaction can generate 738.1 Cal/g of heat. However, boron is also not as commonly used as aluminum in thermite mixtures for the same reasons—i.e., in the presence of water, the reaction rates may be slow and reaction completion may significantly be impacted. In addition, there exist limitations related to the manner by which the metal and metal oxide components are incorporated into a reactive liner—they must be added as separate powder components. After detonation of the shaped charges, this condition requires that these components would need to "find" each other either in the jet or perforation tunnel for the thermite reactions to occur.

In contrast, embodiments of the invention use boron in intermetallic reactions. Boron-type intermetallic reactions are attractive because they do not rely on oxygen-boron interactions, thus, allowing one to use boron without the concern of adverse oxidation effects impacting the reaction rates. In addition, unlike thermite reactions, boron intermetallic components can be incorporated as alloyed powders, metal-coated boron powders, or boron-coated metal powders, and, therefore, these components are ready to react and need not find each other after detonation of the shaped charges.

As used herein, the term an "intermetallic mixture" means a system comprising two metal components that can react to generate a substantial amount of heat. A boron-type intermetallic mixture is one having boron as one of the metal components. The other metal component in a boron-type intermetallic mixture may be referred to as a "reactant metal." The term "intermetallic mixture" as used herein may include a system the two components are physically separated in two different parts of a shaped charge, e.g., liner and explosive. These "separated" system will also be referred to as an "intermetallic mixture" in this description because they will become a mixture once the shaped charge is fired. Furthermore, an "intermetallic mixture" in the examples described herein comprise two components—boron and a reactant metal. However, one skilled in the art would appreciate that one can also use three or more components in an intermetallic mixture without departing from the scope of the invention.

In the following description, boron and the reactant metal may be used in the form of powders and/or particles. For clarity, the description may use "powders" in a broad sense to include "particles." Specifically, in this description wherever "powder" is mentioned, one may substitute this with "particle" or use both "powder" and "particle."

Although aluminum is more favorable as a component in thermite mixtures or as a reactive metal for oxidative reactions, boron is actually better for intermetallic reactions because boron-type intermetallic reactions typically release more energy (i.e. are more exothermic) than the Al-type intermetallic reactions. For example, the average ΔH for boron and titanium intermetallic reactions ($B+Ti \rightarrow TiB$; $2B+Ti \rightarrow TiB_2$) is −4.02 kJ/g, whereas ΔH ($3Al+2Ni \rightarrow Ni_2Al_3$)=−1.42 kJ/g.

In addition, many other metals can be used with boron in the boron-type intermetallic reactions. The following Table 1 lists some intermetallic mixtures that can produce substantial heat and the energies that are released from such intermetallic reactions.

TABLE 1

| Reactants | ΔH (KJ/g) | Reactants | ΔH (KJ/g) |
|---|---|---|---|
| 4B + C | −1.28 | 2B + Ta | −1.03 |
| 6B + Ce | −1.65 | 4B + Th | −0.79 |
| 2B + Cr | −1.28 | B + Ti | −2.73 |
| 2B + Hf | −1.68 | 2B + Ti | −5.52 |
| 6B + La | −2.34 | 2B + U | −0.62 |
| 2B + Mg | −2.00 | 4B + U | −0.87 |
| 6B + Mg | −1.05 | B + V | −2.24 |
| 2B + Mn | −1.23 | 2B + V | −2.81 |
| 2B + Mo | −0.82 | 5B + 2W | −0.35 |
| 2B + Nb | −2.19 | 6B + Y | −0.65 |
| 6B + Sm | −0.97 | 2B + Zr | −2.86 |
| 6B + Si | −0.32 | | |

All these reactant metals may be used in embodiments of the invention to participate in intermetallic reactions with boron to produce substantial amounts of heat. As can be seen from Table 1, some of these reactant metals (e.g., La, Mg, Nb, Ti, V, and Zr) can produce more heat than others. However, the costs for these reactant metals would be a factor to consider. Therefore, one may select the types of reactant metals based on the desired effects and/or purposes. For example, the intermetallic mixtures in accordance with embodiments of the present invention may include Ti/B, Mg/B, Zr/B, Mo/B, etc.

The intermetallic mixtures usually require relatively high temperatures (typically >1000 K) to initiate the intermetallic reactions. Therefore, the components of an intermetallic mixture may be mixed together without much concerns of dangers or degradation over long term storage. This is advantageous, as compared to thermite mixtures.

Therefore, in accordance with embodiments of the invention, the components of an intermetallic mixture to be used in a shaped charge can be either mixed into the same part or different parts of a shaped charge. For example, in accordance with some embodiments of the invention, boron and the reactant metal may be mixed into a powder blend used for making a liner, or one of he components may be mixed in with the explosive and the other in the liner.

Figure 2:
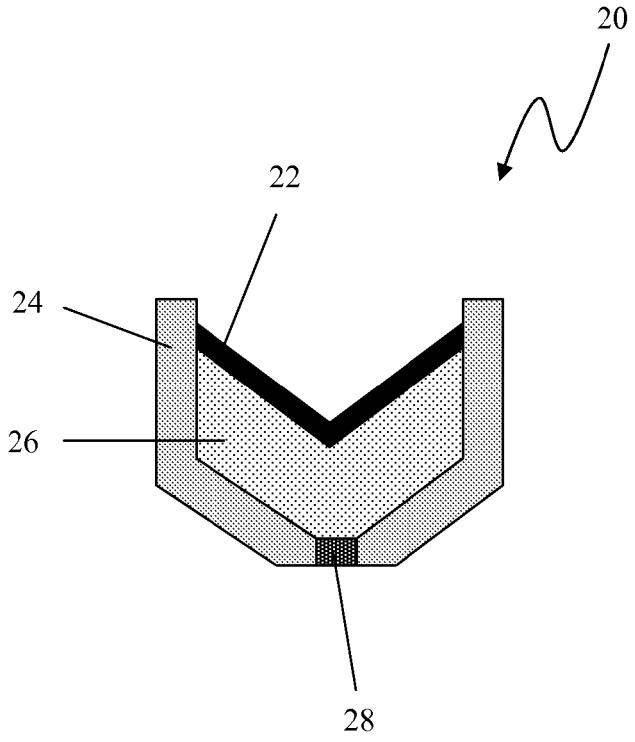
FIG. 2 shows a cross-sectional layout of a shaped charge in accordance with one embodiment of the invention.

FIG. 2 shows a cross-section view of a shaped charge 20 according to one embodiment of the invention. Shaped charge 20 includes a liner 22 and a casing 24, forming a cavity. An explosive 26 is enclosed within the cavity. Furthermore, an explosive primer 28 is located at the base of the cavity to enhance the detonation transfer from the detonating cord (not shown). The liner 22 is converted into the shaped charge jet upon detonation of the explosive, and it also helps retain the explosive 26 in the cavity of the casing 24.

Explosive 26 may contain any suitable explosive materials known in the art, such as RDX (hexahydro-1,3,5-trinitro-1,3,5-triazine), FINS (hexanitrostilbene), HMX (1,3,5,7-tetranitro-1,3,5,7-tetraazacyclooctane), PETN (pentaerythritol tetranitrate), TATB (triaminotrinitrobenzene), and/or PYX (2,6-bis picrylamino-3,5-dinitropyridine).

In accordance with some embodiments of the invention, boron and the reactant metal in an intermetallic mixture may be included in a liner. In this configuration, the boron metal and the other metal may be included in the liner in several manners: (i) both are added as separate powders or separate particles; (ii) the reactant metal is coated on granules of boron, or vice versa; and (iii) boron and the reactant metal are made into an alloy.

Figure 3:
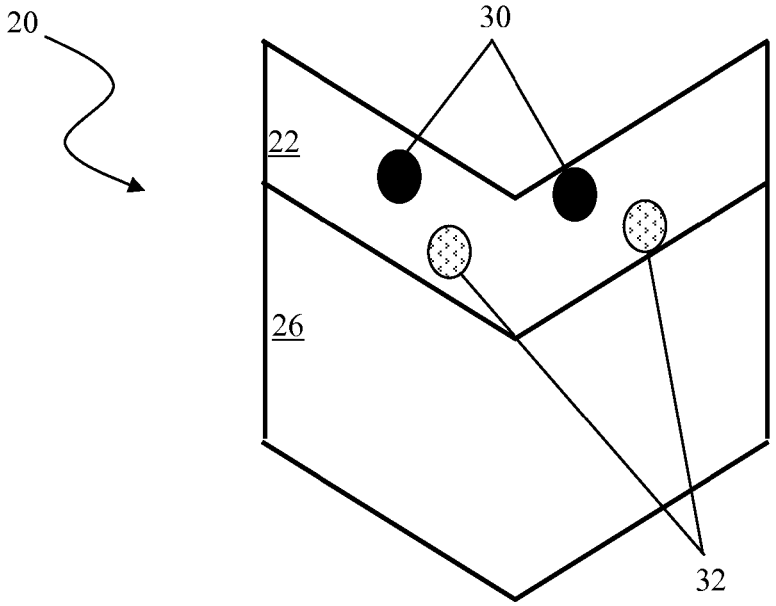
FIG. 3 shows a cross-sectional layout of a shaped charge in accordance with one embodiment of the invention.

FIG. 3 illustrates one embodiment of the invention, in which both boron and the reactant metal are added to the liner as powders and/or particles. FIG. 3 shows a schematic illustrating a cross-section view of a liner 22 and an explosive 26 of a shaped charge 20. Liner 22 may contain a mixture of boron powders/particles 30 and the reactant metal powders/particles 32. The reactant metal powders/particles 32, for example, may be Ti, Mg, Zr, Mo, etc. In an alternative embodiment, one may also put the powders and/or particles of boron and the reactant metals in the explosive, instead of the liner.

Figure 4:
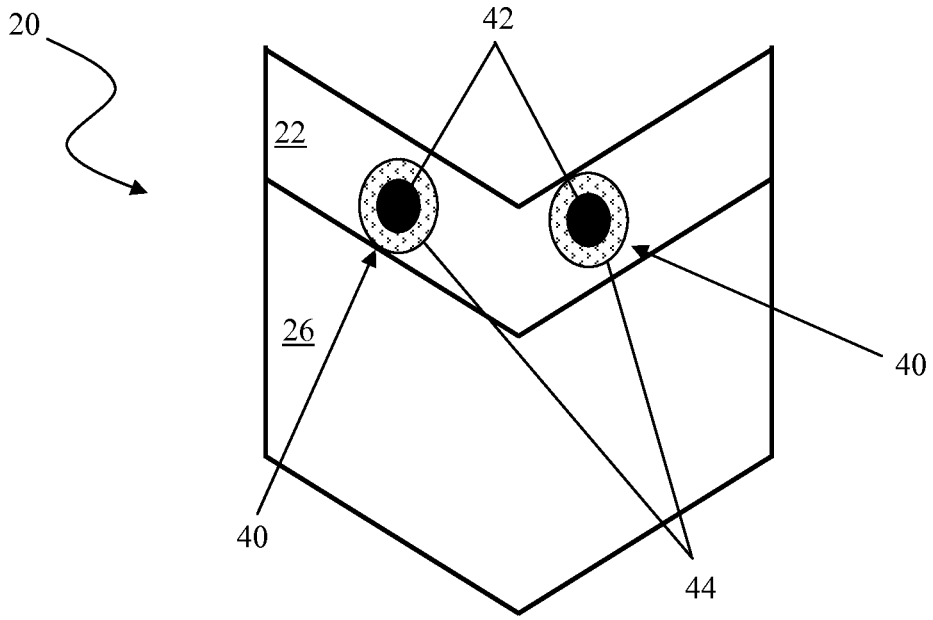
FIG. 4 shows a cross-sectional layout of a shaped charge in accordance with one embodiment of the invention.

FIG. 4 illustrates one embodiment of the invention, in which boron particles are coated with the reactant metal before they are added to a liner. FIG. 4 shows a schematic illustrating a cross-section view of liner 22 and explosive 26 of a shaped charge 20 according to one embodiment of the invention. Liner 22 contains intermetallic particles 40, which are boron particles 42 coated with the reactant metal coatings 44. The reactant metal coatings 44 may be Ti, Mg, Zr, Mo, etc. One skilled in the art would appreciate that the coated particles may also comprise the reactant metal as the core and boron as the coating.

Figure 5:
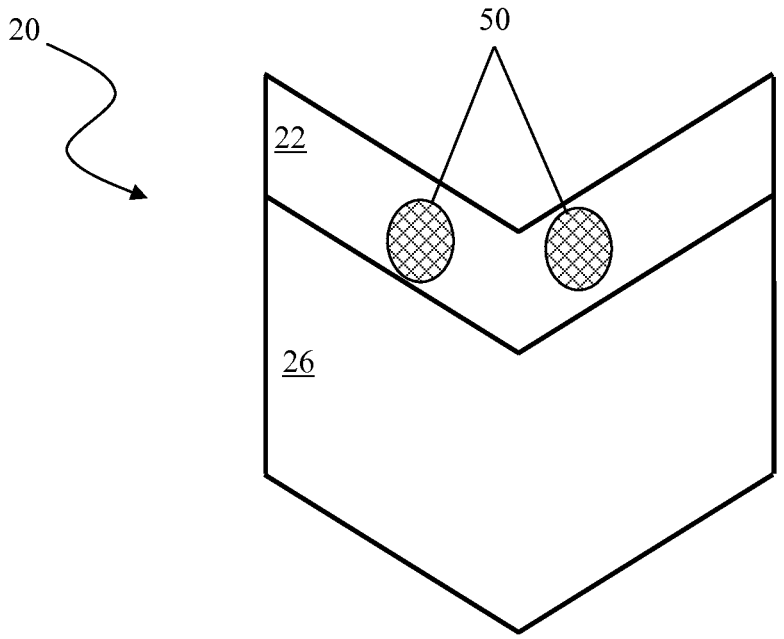
FIG. 5 shows a cross-sectional layout of a shaped charge in accordance with one embodiment of the invention.

FIG. 5 illustrates one embodiment of the invention, in which both boron and the reactant metal are added to a liner as an alloy. FIG. 5 shows a schematic illustrating a cross-section view of liner 22 and explosive 26 of a shaped charge 20 according to one embodiment of the invention. Liner 22 may contain reactant metal-B alloy powders/particles 50. The reactant metal-B alloy powders/particles 50 may include Ti/B, Mg/B, Zr/B, Mo/B alloy, etc.

Figure 6:
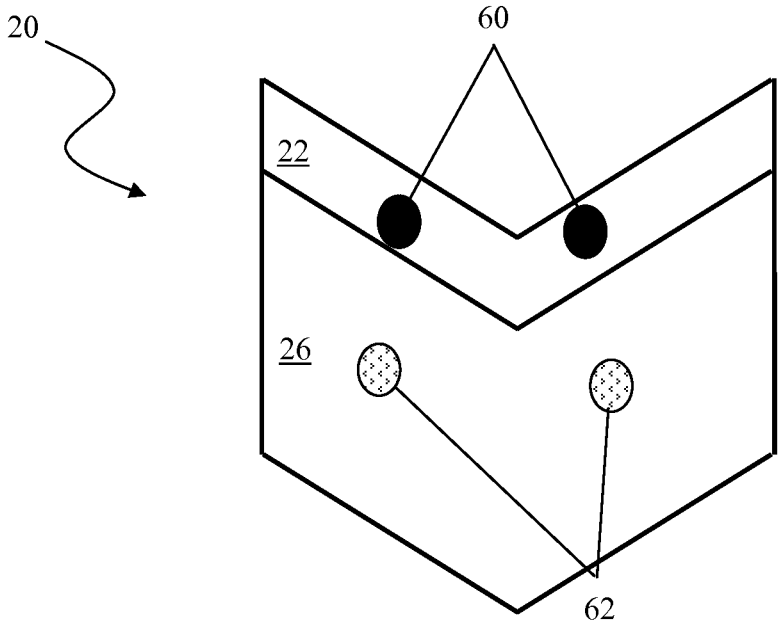
FIG. 6 shows a cross-sectional layout of a shaped charge in accordance with one embodiment of the invention.
Figure 7:
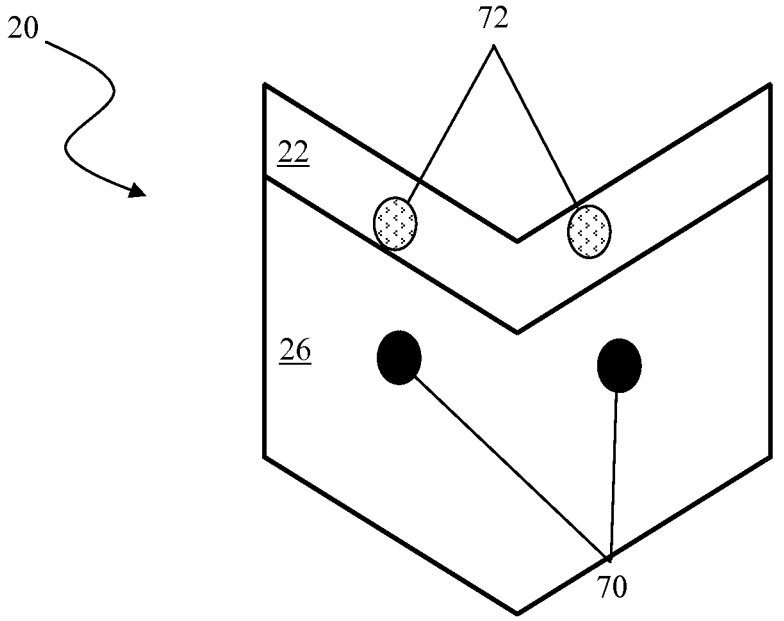
FIG. 7 shows a cross-sectional layout of a shaped charge in accordance with one embodiment of the invention.

FIGS. 6 and 7 illustrate other embodiments of the invention, in which boron and the reactant metal are added to separate parts of a shaped charge. In these embodiments, the boron and the reactant metal are not in a "mixture" in a strict sense. Nevertheless, the term an "intermetallic mixture" as used herein intends to include these situations, where boron and the reactant metal are deposited in different parts of a shaped charge. Even though they are in different parts of a shaped charge, these components will be mixed and form a "mixture" once the shaped charge is fired.

FIG. 6 shows a schematic illustrating a cross-section view of liner 22 and explosive 26 of a shaped charge 20 according to one embodiment of the invention. Liner 22 may contain boron powders/particles 60 and explosive 26 may contain reactant metal powders/particles 62. The reactant metal powders 62 may include Ti, Mg, Zr, Mo, etc. After the charge is initiated boron powders 60 and metal powder 62 may be mixed together in the penetrating jet.

An alternative embodiment to the one shown in FIG. 6 is illustrated in FIG. 7, which shows a schematic illustrating a cross-section view of liner 22 and explosive 26 of a shaped charge 20 according to one embodiment of the invention. Explosive 26 may contain boron powders 70 and liner 22 may contain reactant metal powders 72. The reactant metal powders 72 may include Ti, Mg, Zr, Mo, etc. After the charge is initiated boron powders 70 and metal powder 72 may be mixed together in the penetrating jet.

Figure 8:
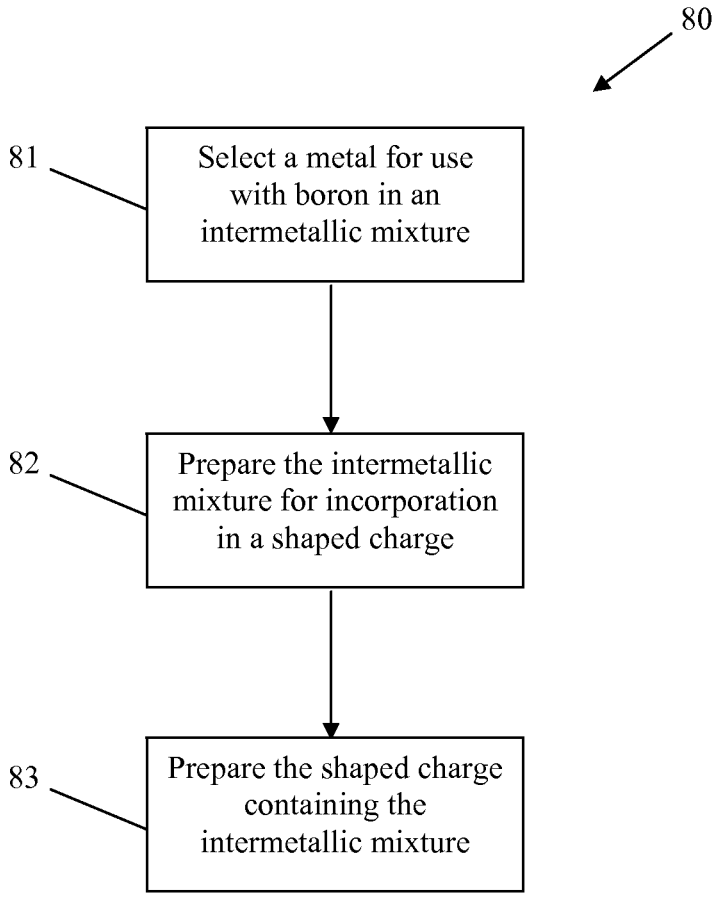
FIG. 8 shows a method for manufacturing a shaped charge in accordance with one embodiment of the invention.

Some embodiments of the invention relate to methods of manufacturing a shaped charge of the invention as described above. FIG. 8 shows a method 80 in accordance with one embodiment of the invention. As shown, method 80 include the step of selecting a reactant metal for use with boron in an intermetallic mixture (step 81). Then, one decides how these components are to be incorporated into a shaped charge (step 82). For example, boron and the reactant metal may be incorporated into the shaped charge as separate powers in a liner or in separate parts (liner and explosive) of a shaped charge. In this case, there is no need to process these two components prior to incorporating them into a shaped charge. Alternatively, boron and the reactant metal may be pre-processed into an alloy or coated particles, as described above. Then, the intermetallic components are used to prepare a shaped charge containing the intermetallic components (step 83).

One skilled in the art would appreciate that the method 80 shown in FIG. 8 is for illustration only. Many variations and modifications to these procedures are possible without departing from the scope of the invention. For example, one may purchase a pre-manufactured alloy or coated particles from a commercial source. In this case, steps 81 and 82 would not be necessary.

Figure 9:
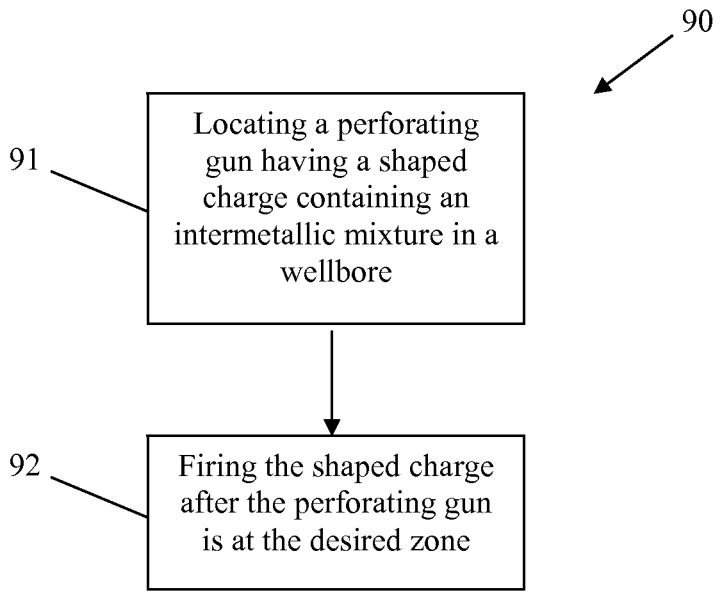
FIG. 9 shows a method for perforating a well in accordance with one embodiment of the invention.

Perforating devices, such as perforating guns, using shaped charges that incorporate boron-type intermetallic reactions according to embodiments of the invention may be used in perforating operations. For example, FIG. 9 shows a method 90 of perforating a formation in accordance with embodiments of the invention. As shown, the method 90 include the step of locating a perforating gun in a wellbore (step 91), wherein the perforating gun contains a shaped charge that has a boron-type intermetallic mixture in accordance with embodiments of the invention illustrated above. Once the perforating gun is in the wellbore at the desired zone (depth), the shaped charge may be fired to create perforations in the well casing and/or nearby formation. (step 92).

Advantages of embodiments of the invention may include one or more of the following. Embodiments in accordance with the invention described here may incorporate all the reactive elements into the shaped charge itself, resulting in a more robust and reliable reaction system. Fore example, shaped charges of the invention may provide faster reaction rates by allowing one to tailor the reactants using either metal-coated B particles or metal-B alloy, such as Ti—B alloy, particles where the reactants are incorporated together. Furthermore, B may be incorporated into the AstrosSilver shaped charge technology since the Ti—B reaction may enhance the energetic characteristics.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A shaped charge, comprising:

a casing;

a liner located within an opening of the casing; and an explosive located between the casing and the liner, wherein at least one of the liner and the explosive comprises an intermetallic mixture comprising boron and a reactant metal, wherein further the liner comprises the intermetallic mixture and the intermetallic mixture comprises coated particles of boron and the reactant metal.

2. The shaped charge of claim 1, wherein the intermetallic mixture comprises an alloy of boron and the reactant metal.

3. The shaped charge of claim 1, wherein the coated particles comprise boron particles coated with the reactant metal.

4. The shaped charge of claim 1, wherein the coated particles comprise reactant metal particles coated with boron.

5. The shaped charge of claim 1, wherein the intermetallic mixture comprises powders and/or particles of boron and powders and/or particles of the reactant metal.

6. The shaped charge of claim 5, wherein the liner comprises the powders and/or particles of boron and the powders and/or particles of the reactant metal.

7. The shaped charge of claim 5, wherein the explosive comprises the powders and/or particles of boron and the powders and/or particles of the reactant metal.

8. The shaped charge of claim 1, wherein the explosive comprises the reactant metal or boron.

9. The shaped charge of claim 1, wherein the reactant metal is one selected from the group consisting of Ti, Mg, Zr, Mo, and a combination thereof.

10. A perforating gun, comprising a shaped charge comprising: a casing; a liner located within an opening of the casing; and an explosive located between the casing and the liner, wherein at least one of the liner and the explosive comprises an intermetallic mixture comprising boron and a reactant metal; wherein further the liner comprises the intermetallic mixture and the intermetallic mixture comprises coated particles of boron and the reactant metal.

11. The perforating gun of claim 10, wherein the intermetallic mixture comprises an alloy of boron and the reactant metal.

12. The perforating gun of claim 10, wherein the intermetallic mixture comprises powders and/or particles of boron and powders and/or particles of the reactant metal.

13. The perforating gun of claim 12, wherein the liner comprises the powders and/or particles of boron and the powders and/or particles of the reactant metal.

14. The perforating gun of claim 10, wherein the liner comprises boron and the explosive comprises the reactant metal, or the liner comprises the reactant metal and the explosive comprises boron.

15. The perforating gun of claim 10, wherein the reactant metal is one selected from the group consisting of Ti, Mg, Zr, Mo, and a combination thereof.

16. A method for manufacturing a shaped charge, comprising:

obtaining an intermetallic mixture comprising coated boron particles and a reactant metal; and preparing a shaped charge comprising: a casing; a liner located within an opening of the casing; and an explosive located between the casing and the liner, wherein at least one of the liner and the explosive incorporates the intermetallic mixture.

17. A method for perforating in a well, comprising:

positioning a perforating gun in the well, wherein the perforating gun comprises a shaped charge that comprises: a casing; a liner located within an opening of the casing; and an explosive located between the casing and the liner, wherein at least one of the liner and the explosive comprises an intermetallic mixture comprising coated boron particles and a reactant metal; and detonating the shaped charge in the well.

* * * * *